United States Patent [19]

Brandell

[11] 4,147,356

[45] Apr. 3, 1979

[54] GOLF SWING PRACTICE DEVICE

[76] Inventor: John R. Brandell, 702 Waukegan Rd., Glenview, Ill. 60025

[21] Appl. No.: 871,224

[22] Filed: Jan. 23, 1978

[51] Int. Cl.[2] ..... A63B 69/36

[52] U.S. Cl. ..... 273/183 B; 273/187 B; 273/188 A

[58] Field of Search ..... 273/188 R, 188 A, 183 B, 273/187 R, 187 A, 187 B, 32 E, 190 R, 195

[56] References Cited

U.S. PATENT DOCUMENTS 3,880,431 4/1975 Swanson ..... 273/183 B 3,955,821 5/1976 Spedding ..... 273/188 A X

*Primary Examiner*—George J. Marlo

*Attorney, Agent, or Firm*—Emrich, Root, O'Keeffe & Lee

[57] ABSTRACT

A golf swing practice device embodying a foot rest and a brace member projecting upwardly therefrom in position whereby, when a golfer makes a golf swing with his rear foot resting on the foot rest the brace engages the leg of the golfer in such a manner as to afford an indication of undesirable swaying during the golf swing and, in fact, acts to prevent such swaying.

14 Claims, 3 Drawing Figures

GOLF SWING PRACTICE DEVICE

BACKGROUND OF THE INVENTION

This invention relates to golf swing practice devices, and, more particularly, to golf swing practice devices that will assist in preventing undesirable swaying by a golfer during his back swing.

A primary object of the present invention is to afford a novel golf swing practice device.

Another object is to afford a novel golf swing practice device for teaching a golfer to avoid undesirable swaying when he is making his back swing.

Golf swing practice devices for assisting in training a golfer to avoid undesirable swaying during his back swing have been therefore known in the art. However, golf swing practice devices of the aforementioned type heretofore known in the art have commonly had several inherent disadvantages, such as, for example, being difficult to use; being large and cumbersome in size; being complicated in construction and operation; and being impractical and inefficient in operation, and the like. It is an important object of the present invention to overcome such disadvantages.

Another object of the present invention is to afford a novel golf swing practice device of the aforementioned type which may be quickly and easily assembled and disassembled.

A further object is to afford a novel golf swing practice device of the aforementioned type which, when assembled or disassembled is relatively small and compact in size.

Another object is to afford a novel golf swing practice device of the aforementioned type which is simple and uncomplicated in operation, while being highly reliable in operation.

Another object of the present invention is to afford a novel golf swing practice device of the aforementioned type which not only affords a golfer practicing therewith an indication of a tendency to sway during his back swing, but, in fact, affords effective protection against such swaying.

A further object of the present invention is to afford a novel golf swing practice device of the aforementioned type which may be quickly and easily adjusted for use by golfers of different size or build.

An object ancillary to the foregoing is to enable such adjustment to be made in a novel and expeditious manner.

Another object of the present invention is to afford a novel golf swing practice device of the aforementioned type which is practical and efficient in operation and which may be readily and ecomonically produced commercially.

Other and further objects of the present invention will be apparent from the following description and claims and are illustrated in the accompanying drawings which, by way of illustration, show a preferred embodiment of the present invention and the principles thereof and what I now consider to be the best mode in which I have contemplated applying these principles. Other embodiments of the invention embodying the same or equivalent principles may be used and structural changes may be made as desired by those skilled in the art without departing from the present invention and the purview of the appended claims.

DESCRIPTION OF THE EMBODIMENT SHOWN HEREIN

Figure 1:
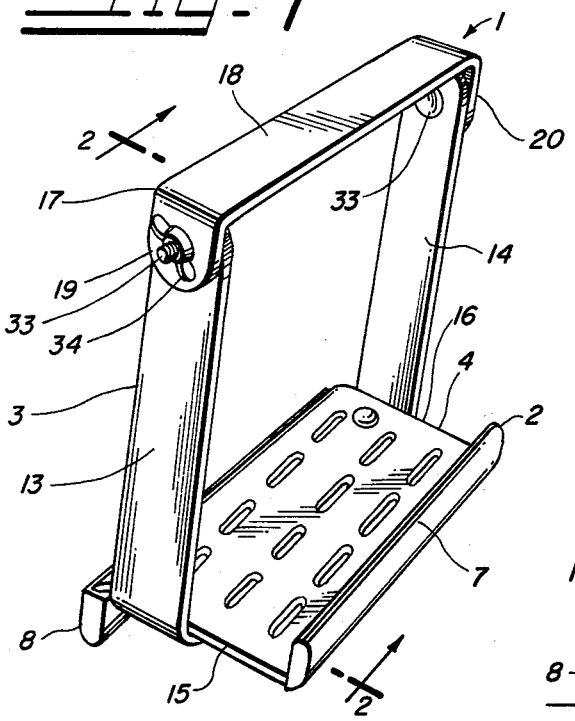
FIG. 1 is a front perspective view of an assembled golf swing practice device embodying the principles of the present invention.

A golf swing practice device 1, embodying the principles of the present invention, is shown in the drawings to illustrate the presently preferred embodiment of the present invention.

The golf swing practice device 1 embodies, in general, a tread plate or foot rest 2 having a substantially inverted, U-shaped member or brace 3 mounted thereon and projecting upwardly therefrom. As will be discussed in greater detail presently, the member 3 is so disposed relative to the foot rest 2, that, when a golfer is using the device 1 and places his rear foot on the foot rest 2, with the member 3 adjusted to the proper position for that particular golfer, the member 3 engages his right leg in such a manner, after the golfer has taken a proper stance, that if the golfer tends to sway rearwardly during his back swing, the member 3 presses against the golfer's leg as a reminder to him not to sway and, in fact, in a manner which tends to prevent such undesirable swaying.

The foot rest 2 may be made of any suitable material, such as, for example, aluminum and embodies a substantially rectangular shaped body portion 4 having a foot supporting portion 5 on the upper face thereof. Preferably, the foot supporting surface 5 has corrugations, such as the corrugations 6 thereon to afford a roughened surface to assist in preventing slipping when a golfer is standing thereon.

Figure 3:
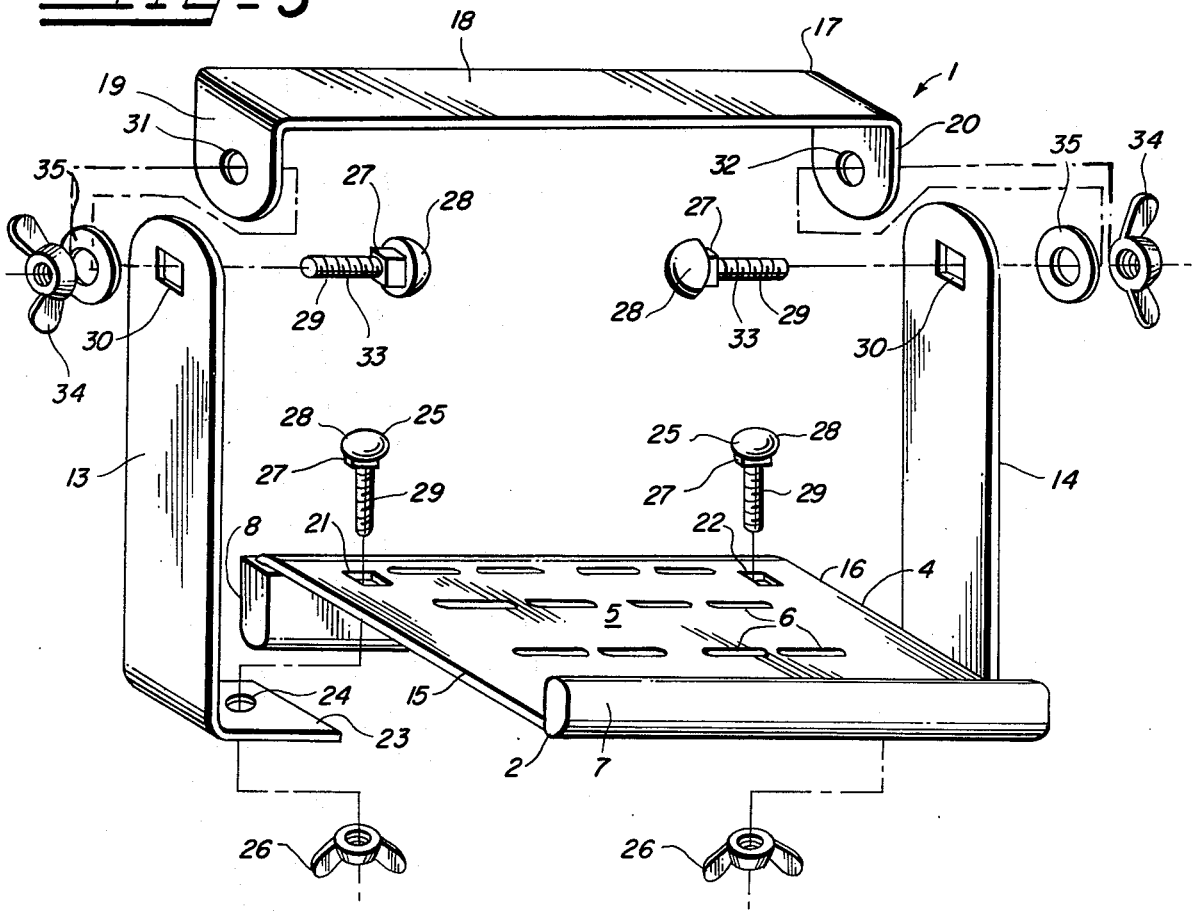
FIG. 3 is an exploded, front perspective view of the golf swing practice device shown in FIG. 1.

A flange 7 extends along and projects upwardly from the front edge of the body portion 4 of the foot rest 2, and a similar flange 8 extends along and projects downwardly from the rear edge portion of the body portion 4 of the foot rest 2, FIG. 3. Pads 9 and 10 are mounted on and completely cover the flanges 7 and 8, respectively, and extend onto the adjacent portions of the body member 4, for a purpose which will be discussed in greater detail presently. The pads 9 and 10 may be made in any suitable manner and of any suitable material, but, preferably, are made by applying a suitable coating of a suitable elastomeric material, such as, for example, liquid latex or a vinyl, having a thickness of one-eighth of an inch, by dip coating the flanges 7 and 8 and the adjacent edge portions of the body portion 4.

The inverted U-shaped member 3 has two uprights or supporting members 13 and 14 mounted on and projecting upwardly from the rear edge portion of the body portion 4 of the foot rest 2 adjacent to respective ends 15 and 16 of the body portion 4, FIG. 1; and includes a crossbar 17, which extends between and is mounted on the upper end portions of the supporting members 13 and 14. The crossbar 17 includes an elongated body portion 18 having two flanges 19 and 20 projecting downwardly from respective ends of the body portion 18, the flanges 19 and 20 being pivotally attached to the upper end portions of the supporting members 13 and 14, respectively, in a manner and for a purpose which will be discussed in greater detail hereinafter.

In the golf swing practice device 1 shown in the drawings, the body portion 4 of the foot rest 2 has two square openings 21 and 22 extending through the rear edge portion thereof in closely adjacent relation to the ends 15 and 16. The supporting members 13 and 14 of the golf swing practice device 1 are identical in construction, each embodying a flange 23 extending from the lower end portion thereof. A round opening 24 extends through each of the respective flanges 23.

In mounting the supporting members 13 and 14 on the foot rest 2, the flanges 23 on the supporting members 13 and 14 are preferably first disposed in underlying relation to the body portion 4, with the openings 24 therein disposed in alignment with the openings 21 and 22, respectively, in the body portion 4. Thereafter, suitable fastening members such as, for example, bolts 25 are inserted downwardly through the respective openings 21 and 22 and the underlying openings 24, and suitable securing members, such as, for example, wing nuts 26 are threaded onto the bolts 25 below the flanges 23 to thus secure the supporting members 13 and 14 to the foot rest 2. Preferably, the bolts 25 are of such construction that they embody square body portions 27 on the shanks thereof immediately adjacent the heads 28, with the square body portions 27 being of such a size that they will fit into the openings 21 and 22 with snug but freely slidable fit, effective to prevent the bolts from turning in the foot rest 2. The remainder or main body portions 29 of the shanks of the bolts 25 constitute the threaded portions thereof and preferably are round in cross section and of a smaller cross sectional size than the square body portions 27, being of such size that they will fit through the openings 24 in the flanges 23 of the supporting members 13 and 14 with a relatively snug, but freely slidable fit.

Each of the supporting members 13 and 14 has a square opening 30 extending through the upper end portion thereof, FIG. 3, which preferably is of the same size as the openings 21 and 22 in the foot rest 2. Similarly, the flanges 19 and 20 of the crossbar 17 have round openings 31 and 32 extending therethrough, respectively, which preferably are of the same size as the openings 24 in the supporting members 13 and 14.

In mounting the crossbar 17 on the supporting members 13 and 14, the flanges 19 and 20 may be disposed outwardly of the upper end portions of the members 13 and 14, respectively, with the openings 31 and 32 disposed in axial alignment with the opening 30 in the upper end portion of the adjacent supporting member 13 and 14. Thereafter, two bolts 33, which are identical in construction to the bolts 25 and the parts of which are identified herein with the same reference numerals as the corresponding parts of the bolts 25, may be inserted outwardly through respective ones of the openings 30 in the supporting members 13 and 14, with the square body portions 27 thereof disposed in the respective opening 30 and the round main body portions 29 thereof projecting outwardly through the outwardly adjacent one of the openings 31 and 32 in the crossbar 17. The bolts 33 may then be releasably secured in the brace 3 by suitable means such as wing nuts 34 threaded onto the outwardly projecting ends of the bolts 33, FIG. 1.

Figure 2:
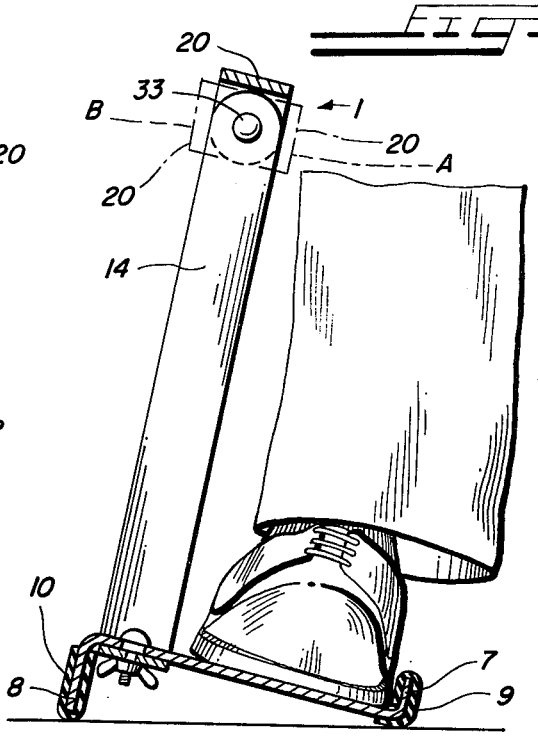
FIG. 2 is a transverse sectional view taken substantially along the lines 2—2 in FIG. 1.

With this construction, when the nuts 34 are loosened on the bolts 33, the crossbar 17 is pivotally adjustable around the round main body portions of the bolts 33 between a forwardly projecting position A, shown in broken lines in FIG. 2, wherein it projects forwardly from the supporting members 18 and 14 in perpendicular relation thereto; and a rearwardly projecting position B, also shown in broken lines in FIG. 2, wherein it projects rearwardly from the supporting members 13 and 14 in perpendicular relation thereto. Normally, the adjusted position of the crossbar 17 will be somewhere between the extreme forward position A and the extreme rearward position B, such as, for example, the intermediate position in which it is shown in solid lines in FIG. 2, as will be discussed in greater detail presently.

Because it is desirable that, when the nuts 34 are tightened on the bolts 33, the crossbar be firmly held against dislodgment from adjusted position on the supporting members 13 and 14, I prefer to mount a friction washer 35, made of suitable material, such as, for example, neoprene, or each of the bolts 33, between the supporting members 13 and 14 and the adjacent flanges 19 and 20, respectively.

With this construction, in the assembled golf swing practice device 1, the supporting members 13 and 14 are disposed substantially perpendicular to the foot supporting surface 5 of the foot rest 2, and the body portion 18 of the crossbar 17 is disposed in upwardly spaced, substantially parallel relation to the supporting surface 5 of the foot rest 2, and forms the bight portion of the inverted U-shaped member or brace 3.

In the golf swing practice device 1 shown in the drawings, the body portion 4 of the foot rest 2 preferably has a width of not substantially less than five and one-quarter inches and not substantially more than five and three-quarter inches, and preferably in the nature of five and one-half inches, and a length of not substantially less than thirteen and one-half inches and not substantially more than fourteen and one-half inches, and preferably in the nature of fourteen inches. With this construction, it has been found that the foot rest 2 will comfortably accommodate a mans shoe up through a size thirteen.

Also, in the golf swing practice device 1, the length of the supporting members 13 and 14 is such that the crossbar 17 is spaced from the foot supporting surface 5 a distance not substantially less than thirteen inches and not substantially more than fifteen inches, and preferably fourteen inches. With the members 13, 14 and 17 having a width of not substantially less than one and one-quarter inches, and not substantially more than one and three-quarter inches, and preferably one and one-half inches. The thickness is preferably in the nature of one-eighth inch. With this construction, it has been found that when an adult of normal size is standing with his or her foot on the supporting surface 5, the crossbar 17 will be disposed no higher than at the knee of such person, and, normally, at approximately the top portion of the person's calf.

In addition, in the golf swing practice device 1, the flange 8 preferably is of such a width that when the foot rest 2 is lying on a flat, level surface, with the front edge of the body portion 4 engaging the surface, and the free edge of the flange 8 engaging the surface, the body portion 4 of the foot rest 2 is disposed at an acute angle to that surface of not substantially less than eight degrees and not substantially more than fifteen degrees, and preferably ten degrees. With this construction, the foot rest 2 affords an effective brace against movement of the foot during a golf swing and insures proper positioning of the golfers foot during such a swing, which is effective to assist in guarding against swaying.

Also, in the golf swing practice device 1, the flange 7 preferably has a width of not substantially less than three-quarters of an inch and not substantially more than one inch, and preferably seven-eighths of an inch. With this construction, the flange 7 affords an effective brace for insuring against slippage of the golfers foot inwardly off from the foot rest 2, while not affording an obstruction that projects upwardly a sufficient distance to interfere with proper and comfortable positioning of the foot.

In the use of the golf swing practice device 1 shown in the drawings, the device is placed on the ground or other supporting surface on which the golfer is going to stand during the taking of the practice swings, with the front bottom edge of the body portion 4 of the foot rest 2 and the bottom edge of the flange 8 resting on the supporting surface, with the inverted U-shaped member 3 projecting upwardly from the foot rest 2, FIG. 1. The supporting surface, of course, does not need to be the ground, but may be a finished surface such as the floor of the room in a house, or the like, where the golfer is going to take his practice swings, and the pads 9 and 10 on the device 1 affording effective protection against the device 1 scratching or otherwise damaging such finished surfaces, as well as affording protection against slipping thereon.

With the device 1 disposed in proper position on the supporting surface, the golfer takes his stance for addressing a ball, with his rear foot resting on the foot supporting surface 5. In the case of a right-handed golfer, this means that it is his right foot that rests on the supporting surface 5, the foot being placed thereon rearwardly of the flange 7 with the toe pointing toward the end 15 and the heel pointing toward the end 16. With the golf swing practice device 1 constructed in the manner shown herein, when the golfer takes his "address" position, with his foot thus disposed on the foot supporting surface 5, the crossbar 17, when in proper position, is disposed in firm but comfortable engagement with his rear leg at a position where, if the golfer is a normal size adult, the crossbar is disposed slightly below the golfers knee. If, when the golfer takes his aforementioned "stance", the crossbar 17 does not firmly engage his leg in the aforementioned manner, the wing nuts 34 should be loosened and the crossbar 17 rotated on the bolts 33 into position wherein the portion 18 of the crossbar 17 will so engage his leg when he assumes his aforementioned proper stance, and the nuts 34 again tightened to hold the crossbar 17 in this properly adjusted position.

With the device 1 properly adjusted, and with the golfer positioned therein in the aforementioned manner, if, during his back swing, the golfer tends to sway rearwardly (that is, to the right for a right-handed golfer) he will be conscious of the engagement, or the increased pressure of engagement of the crossbar 17 against his rear leg, which affords a signal to him that he has tended to sway in this undesirable manner during his golf swing. In addition, with the crossbar 17 being stationarily fixed with respect to the foot rest 2, in the manner disclosed herein, it actually affords a brace or abutment member which engages the leg in such a manner as to prevent such swaying, or, at least, to prevent excessive swaying.

It is pretty much the opinion of the golfing experts that swaying during the back swing is one of the most undesirable features of the average golfer's golf swing. Also, it is one of the most difficult things for the average golfer to detect, himself; and one of the most difficult things for the skilled instructor to teach his pupil to avoid. With the use of my novel golf swing practice device 1, not only can the golfer, himself, detect when he tends to sway during his back swing, but, in fact, the device tends to prevent him from so swaying. As a result, the device is a very practical, useful tool for practicing the game of golf and assisting a golfer in developing the proper golf swing and overcoming one of the most common bad habits of the average golfer.

With the golf swing practice device 1, constructed in the aforementioned manner, when the golfer is completing his golf swing and moves into his "follow-through", there is ample room for his rear foot to turn and for the heel to rise upwardly and move rearwardly, in the manner that the rear foot should move during the completion of such a golf swing, without striking the crossbar 17 or any other portion of the inverted U-shaped member 3, the crossbar 17 and the members 13 and 14 being so positioned as to permit movement of the rear heel therepast. Thus, with this construction, a relatively small, compact device is afforded, which is readily transportable and can be stored in a relatively small space in assembled condition, while affording a device which will engage the rear leg of the golfer at a point to afford an effective signal if he improperly sways during his back swing, and, in fact, the point being so located that the device effectively acts to prevent such undesirable swaying. All of this is accomplished without the device being so large and cumbersome in size that it is expensive to manufacture or that it will interfere with what should be the proper normal golf swing being practiced therewith.

From the foregoing it will be seen that the present invention affords a novel and practical golf swing practice device.

In addition, it will be seen that the present invention affords a novel device of the aforementioned type which is practical and efficient in operation and which may be readily and ecomonically produced commercially.

Thus, while I have illustrated and described the preferred embodiment of my invention, it is to be understood that this is capable of variation and modification, and I therefore, do not wish to be limited to the precise details set forth, but desire to avail myself of such changes and alterations as fall within the purview of the following claims.

I claim:

1. A golf swing practice device comprising a. a tread plate
   (1) having (a) a front side and (b) a rear side, and
   (2) sloping downwardly from said rear side to said front side, b. two elongated supporting members
   (1) disposed in spaced relation to each other and
   (2) directly attached to said rear side of said tread plate in upwardly projecting relation thereto, and c. a crossbar extending between and mounted on the upper end portions of said supporting members.

2. A golf swing practice device as defined in claim 1, and in which a. said crossbar is
   (1) disposed directly above said tread plate, and (2) spaced therefrom a distance not substantially less than thirteen inches and not substantially more than fifteen inches.

3. A golf swing practice device comprising a. a tread plate
(1) having
(a) a front side and
(b) a rear side, and
(2) sloping downwardly from said rear side to said front side, b. two elongated supporting members
(1) disposed in spaced relation to each other and
(2) directly attached to said rear side of said tread plate in upwardly projecting relation thereto, and c. a crossbar extending between and mounted on the upper end portions of said supporting members, d. said crossbar being adjustable forwardly and rearwardly relative to said tread plate.

4. A golf swing practice device comprising a. a tread plate
(1) having
(a) a front side and
(b) a rear side, and
(2) sloping downwardly from said rear side to said front side, b. two elongated supporting members
(1) disposed in spaced relation to each other and
(2) directly attached to said rear side of said tread plate in upwardly projecting relation thereto, and c. a crossbar extending between and mounted on the upper end portions of said supporting members, d. said crossbar
(1) being of substantially inverted U-shape,
(2) having two end portions releasably secured to said supporting members, and
(3) being pivotable forwardly and backwardly relative to said supporting members when said securing thereof to said supporting members is released.

5. A golf swing practice device comprising a. a foot rest adapted to be directly mounted on a supporting surface in position for a golfer practicing a golf swing to stand on said foot rest with his rear foot, and b. a substantially inverted U-shaped member having
(1) a bight portion, and
(2) two leg portions projecting from respective ends of said bight portion in substantially parallel relation to each other, c. said leg portions being directly secured to said foot rest in position to dispose said bight portion above said foot rest in upwardly spaced relation thereto in position to engage the rear leg of such a golfer when the golfer assumes a proper stance for a golf swing while so standing on said foot rest.

6. A golf swing practice device comprising a. a foot rest
(1) having
(a) a foot supporting surface,
(b) a front edge portion, and
(c) a rear edge portion, and
(2) adapted to be mounted on a flat supporting surface with said foot supporting surface sloping upwardly at an acute angle to the plane of said flat supporting surface from said front edge portion to said rear edge portion, b. two elongated supporting members, c. each of said supporting members having one end portion directly attached to said foot rest, d. said supporting members projecting upwardly from said foot rest in substantially parallel spaced relation to each other, and e. an elongated crossbar extending between and mounted on the upper end portions of said supporting members.

7. A golf swing practice device as defined in claim 6, and in which a. said acute angle is not substantially less than eight degrees and not substantially more than fifteen degrees.

8. A golf swing practice device as defined in claim 6, and in which a. said foot rest comprises
(1) a body portion affording said foot supporting surface, and
(2) a flange projecting downwardly from said body portion and defining said rear edge portion of said foot rest.

9. A golf swing practice device as defined in claim 8, and in which a. each of said supporting members includes a flange projecting laterally from one end thereof, b. said flanges on said supporting members are directly attached to said body portion at the rear edge portion thereof, and c. said crossbar
(1) is attached to the upper end portions of said supporting members, and
(2) is disposed over said rear edge portion of said foot rest.

10. A golf swing practice device as defined in claim 9, and in which a. said foot rest includes
(1) a flange projecting upwardly from said body portion and defining said front edge portion of said foot rest.

11. A golf swing practice device as defined in claim 10, and in which a. said body portion is
(1) substantially flat, and
(2) substantially rectangular in shape, b. said front and rear edge portions are
(1) not substantially less than thirteen and one-half inches long and not substantially more than fourteen and one-half inches long, and
(2) spaced apart not substantially less than five and one-quarter inches and not substantially more than five and three-quarter inches, c. said flanges on said supporting members are directly disposed in underlying engagement with said body portion, and d. said crossbar has a main body portion that is spaced from said body portion of said foot rest not substantially less than thirteen inches and not substantially more than fifteen inches.

12. A golf swing practice device comprising a. a foot rest
(1) having
(a) a foot supporting surface,
(b) a front edge portion, and
(c) a rear edge portion, and
(2) adapted to be mounted on a flat supporting surface with said foot supporting surface sloping upwardly at an acute angle to the plane of said flat supporting surface from said front edge portion to said rear edge portion, b. two elongated supporting members, c. each of said supporting members having one end portion directly attached to said foot rest,
d. said supporting members projecting upwardly from said foot rest in substantially parallel spaced relation to each other, and
e. an elongated crossbar extending between and mounted on the upper end portions of said supporting members,
f. said crossbar
(1) being of substantial inverted U-shape, having
(a) two end portions interconnected by
(b) an intermediate portion, and
(2) havng said end portions pivotally connected to respective ones of said supporting members for rotation forwardly and backwardly relative thereto.

13. A golf swing practice device comprising
a. a foot rest
(1) having
(a) a foot supporting surface,
(b) a front edge portion, and
(c) a rear edge portion, and
(2) adapted to be mounted on a flat supporting surface with said foot supporting surface sloping upwardly at an acute angle to the plane of said flat supporting surface from said front edge portion to said rear edge portion,
b. two elongated supporting members,
c. each of said supporting members having one end portion directly attached to said foot rest,
d. said supporting members projecting upwardly from said foot rest in substantially parallel spaced relation to each other,
e. an elongated crossbar extending between and mounted on the upper end portions of said supporting members,
f. said foot rest comprising
(1) a body portion affording said foot supporting surface, and
(2) a flange projecting downwardly from said body portion and defining said rear edge portion of said foot rest,
g. each of said supporting members including a flange projecting laterally from one end thereof,
h. said flanges on said supporting members being directly attached to said body portion at the rear edge portion thereof,
i. said crossbar
(1) being attached to the upper end portions of said supporting members, and
(2) being disposed over said rear edge portion of said foot rest,
j. said foot rest including
(1) a flange projecting upwardly from said body portion and defining said front edge portion of said foot rest,
k. said body portion being
(1) substantially flat, and
(2) substantially rectangular in shape,
l. said front and rear edge portions being
(1) not substantially less than thirteen and one-half inches long and not substantially more than fourteen and one-half inches long, and
(2) spaced apart not substantially less than five and one-quarter inches and not substantially more than five and three-quarter inches,
m. said flanges on said supporting members being directly disposed in underlying engagement with said body portion,
n. said crossbar having a main body portion that is spaced from said body portion of said foot rest not substantially less than thirteen inches and not substantially more than fifteen inches, and
o. said crossbar
(1) having two end portions projecting from respective ends of said main body portion in substantially parallel relation to each other, and
(2) being pivotally connected to the upper end portions of said supporting members, through said end portions of said crossbar, for forward and rearward adjustment relative to said supporting members.

14. A golf swing practice device comprising
a. an elongated one-piece foot rest having
(1) a substantially flat body portion on which a golfer may stand with his rear foot extending longitudinally of said foot rest during the taking of such a golf swing,
(2) a flange projecting downwardly from the rear edge portion of said body portion in position to hold said body portion on a supporting surface at an upwardly rearwardly opening acute angle to said supporting surface, and
(3) another flange projecting upwardly from the front edge of said body portion in position to engage the inner edge of a golfer's rear foot when that golfer is so standing on said body portion, and
b. a substantially inverted U-shaped member having
(1) an intermediate portion, and
(2) two end portions projecting downwardly from respective ends of said intermediate portion in substantially parallel relation to each other,
c. the lower end portions of said end portions being directly connected to respective opposite sides of said foot rest in position to support said intermediate portion in upwardly spaced relation to said body portion in position to engage the outer side of such a golfer's rear leg when said golfer is so standing on said body portion and assuming a proper stance for making such a golf swing.

* * * * *

UNITED STATES PATENT OFFICE

CERTIFICATE OF CORRECTION

Patent No. 4,147,356 Dated April 3, 1979

Inventor(s) John R. Brandell

It is certified that error appears in the above-identified patent and that said Letters Patent are hereby corrected as shown below:

Col. 1, line 16: change "therefore" to--heretofore;

Col. 4, line 2: change "18" to--13; and

Col. 4, line 18: change "or" to--on.

Signed and Sealed this

*Sixth* Day of *November 1979*

[SEAL]

*Attest:*

RUTH C. MASON
*Attesting Officer*

LUTRELLE F. PARKER
*Acting Commissioner of Patents and Trademarks*